United States Patent [19]

Michaels

[11] 4,085,637

[45] Apr. 25, 1978

[54] APPARATUS FOR CUTTING SCRAP STRIP

[75] Inventor: Walter L. Michaels, Unionville, Conn.

[73] Assignee: Plainville Special Tool, Inc., Plainville, Conn.

[21] Appl. No.: 685,110

[22] Filed: May 10, 1976

[51] Int. Cl.[2] ..... B26D 5/26

[52] U.S. Cl. ..... 83/69; 83/399

[58] Field of Search ..... 83/399, 639, 400, 234, 83/240, 69

[56] References Cited

U.S. PATENT DOCUMENTS

| | | | |
|---|---|---|---|
| 2,268,052 | 12/1941 | Miller | 83/399 |
| 2,870,810 | 1/1959 | Folk | 83/69 |
| 2,928,305 | 3/1960 | Heth et al. | 83/399 |
| 3,640,164 | 2/1972 | Crafford et al. | 83/69 X |
| 3,939,743 | 2/1976 | Coombes | 83/639 X |

*Primary Examiner*—Willie G. Abercrombie

[57] ABSTRACT

An apparatus for cutting scrap strip received from a press or the like has a cutting member driven in reciprocating movement by an air cylinder operatively connected thereto, the cutting member cooperating with a die member to cut scrap strip as desired. A solenoid controlled valve is connected to the air cylinder and is operable to control air flow into and out of the cylinder whereby movement of the cutting member is effected. Control means is connected in circuit relation with the valve and a rotating shaft of the press providing scrap strip and is responsive to rotation of the shaft to control the position of the valve. The interval between successive actuations of the cutting member may be preset to correspond to a desired time interval or a specific number of cycles of the shaft. A manual control connected in circuit relation with the valve is operable to actuate the cutting member independently of periodic movement of the press.

8 Claims, 8 Drawing Figures

APPARATUS FOR CUTTING SCRAP STRIP

BACKGROUND OF THE INVENTION

It is frequently desirable to cut scrap metal being ejected from a press into pieces of specific lengths to facilitate subsequent handling and/or packaging for recycling. In particular, when a press is operable to form elements cut from a continuous coil of metallic strip material the scrap skeleton is generally cut into pieces of manageable size. Exemplary of a device which is designed to cut scrap strip received from a press is that disclosed in U.S. Letters Pat. No. 2,268,052 granted on Dec. 30, 1941 to E. R. Miller. Miller's device, however, is not capable of cutting scrap to a range of lengths without mechanical replacement or rearrangement of parts and has a relatively high number of rapidly moving parts with the corresponding necessity of relatively frequent inspection and/or repair. Moreover, his scrap cutter is not easily portable as it is positively connected to a press via an eccentric/lever linkage.

Accordingly, it is an object of the present invention to provide a novel apparatus for cutting scrap strip which is highly durable and capable of cutting scrap strip to any desired length.

Another object is to provide such an apparatus for cutting scrap strip where either the time interval or number of press cycles between successive cuts is easily controlled.

A further object is to provide such an apparatus which is highly portable and which may be positioned in line or at an angle to the scrap strip to cut a minimum web, thus reducing wear of the cutting member.

SUMMARY OF THE INVENTION

It has now been found that the foregoing and related objects are readily attained in an apparatus for cutting scrap strip which includes a support providing a bed with piston means being mounted on the support for reciprocal movement of a piston toward and away from the bed. The piston has an exposed portion at its end adjacent the bed on which is mounted a cutting member. A die member mounted on the bed cooperates with the cutting member to cut scrap strip being fed along the bed intermediate the cutting and die members. A valve is connected to a source of pressurized fluid and the piston means to effect reciprocation of the piston, the valve having a first operating position wherein the piston is moved toward the bed and a second operating position wherein the piston is moved away from the bed. Electrical control means are connected in circuit relation to the valve and adapted for connection to a press or the like providing scrap strip, the controls including presetting means operable for presetting the interval between successive movements of the valve between its first and second operating positions as described below, and the controls further being responsive to periodic movement of the press to cause the valve to move to the first operating position thereof whereby the piston is actuated and the cutting member is driven toward the die member to cut scrap strip therebetween. The controls move the valve to the second operating position thereof following actuation of the piston whereby the cutting member is moved away from the die member.

In the preferred aspect the piston means comprises an air cylinder with the exposed portion of the piston consisting of a portion of a piston rod connected thereto. A manual control is connected in circuit relation to the valve, which is preferably a two position four way solenoid controlled valve, and is operable to move the valve to its first operating position and return the valve to its second operating position following actuation of the piston.

In one embodiment the electrical controls include a timer for presetting the time interval between successive movements of the valve to its first operating position. Single or double probes are mounted for electrical contact with a rotating shaft of the press once per rotation thereof and are connected to a pulser which applies a pulse to one input of an AND gate each time the probes make electrical contact with the shaft. The timer is connected to the other input of the gate and is operable to satisfy this input when the time interval has expired whereby the next pulse applied by the pulser to the first mentioned gate input is passed by the gate and effects movement of the valve to its first position and resets the timer.

In another embodiment the electrical controls include a counter adapted for monitoring the cyclical movement of the press which is operable for presetting the number of press cycles between successive movements of the valve to its first position. Single or double probes are mounted for electrical contact with a rotating shaft of the press once per rotation thereof and are connected to a pulser which applies a pulse to the counter each time the probes make electrical contact with the shaft. The counter effects movement of the valve to its first position following a preset number of rotations of the shaft.

BRIEF DESCRIPTION OF THE DRAWINGS

FIG. 1 is a side elevational view of an apparatus for cutting scrap strip embodying the present invention with dashed lines indicating internal structure and showing a portion of a rotatable shaft of a press or the like;

DETAILED DESCRIPTION OF THE ILLUSTRATED EMBODIMENT

Figure 1:
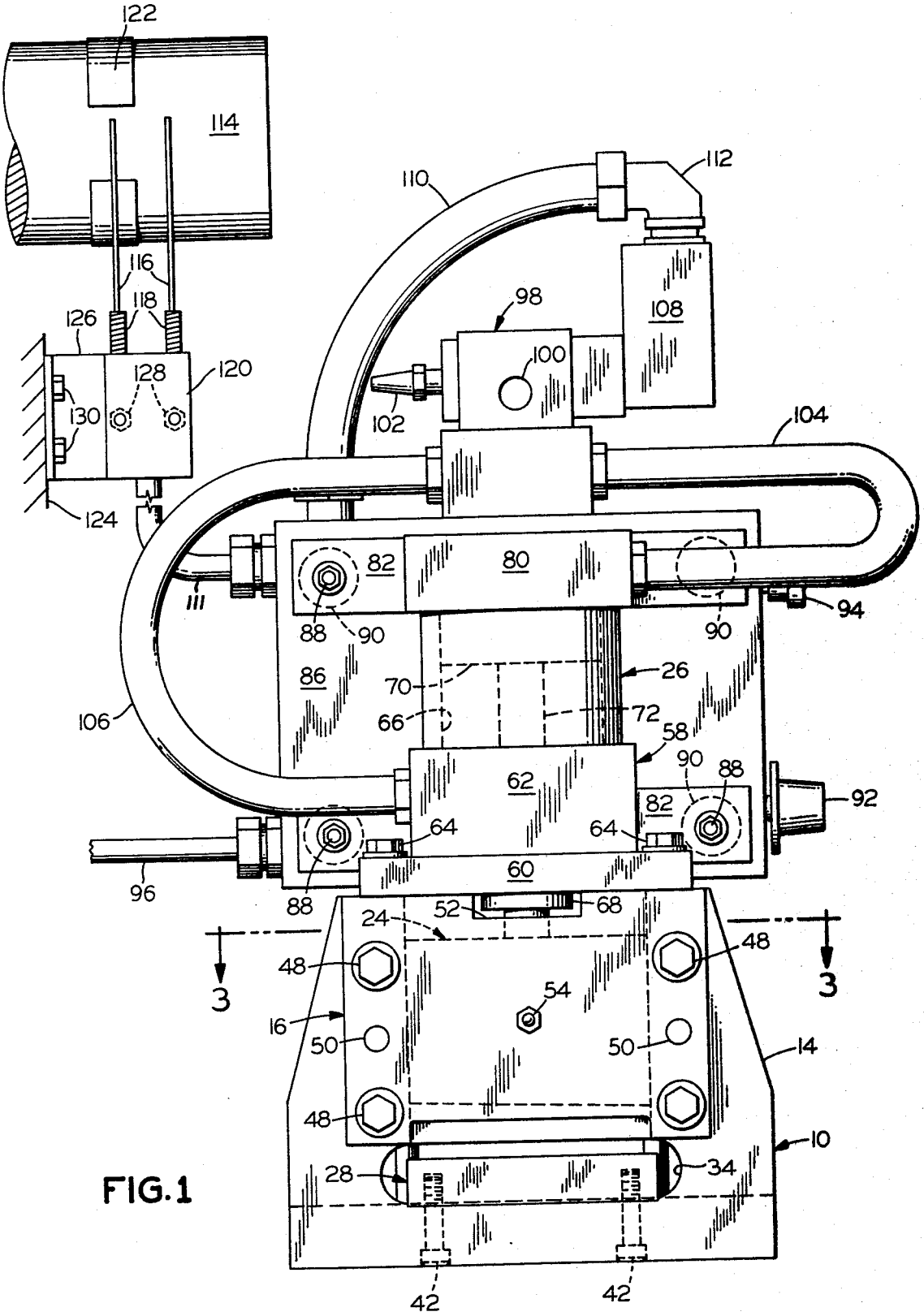

Turning now to the attached drawings in detail, illustrated in FIGS. 1–4 thereof is an apparatus for cutting scrap strip having an L-shaped support member generally designated by the numeral 10 consisting of a horizontal bed 12 and a vertical leg 14. A U-shaped guide member generally designated by the number 16 comprising a pair of spaced parallel legs 18 joined by a web 20 is secured to the outer surface of the leg 14 with the web 20 spaced therefrom to provide a vertical rectangularly cross-sectioned passage 22.

A trapezoidal blade or cutting member generally designated by the numeral 24 is slidably seated in the passage 22 and is driven in reciprocating movement by an air cylinder generally designated by the numeral 26 mounted on the top surfaces of the guide member 16 and leg 14 of the support member 10, the cutting member 24 cooperating with a rectangular die block generally designated by the numeral 28 secured to the bed 12 and projecting through the leg 14 to cut scrap strip 30 received from a press (not shown) or the like into desired lengths.

Figure 4:
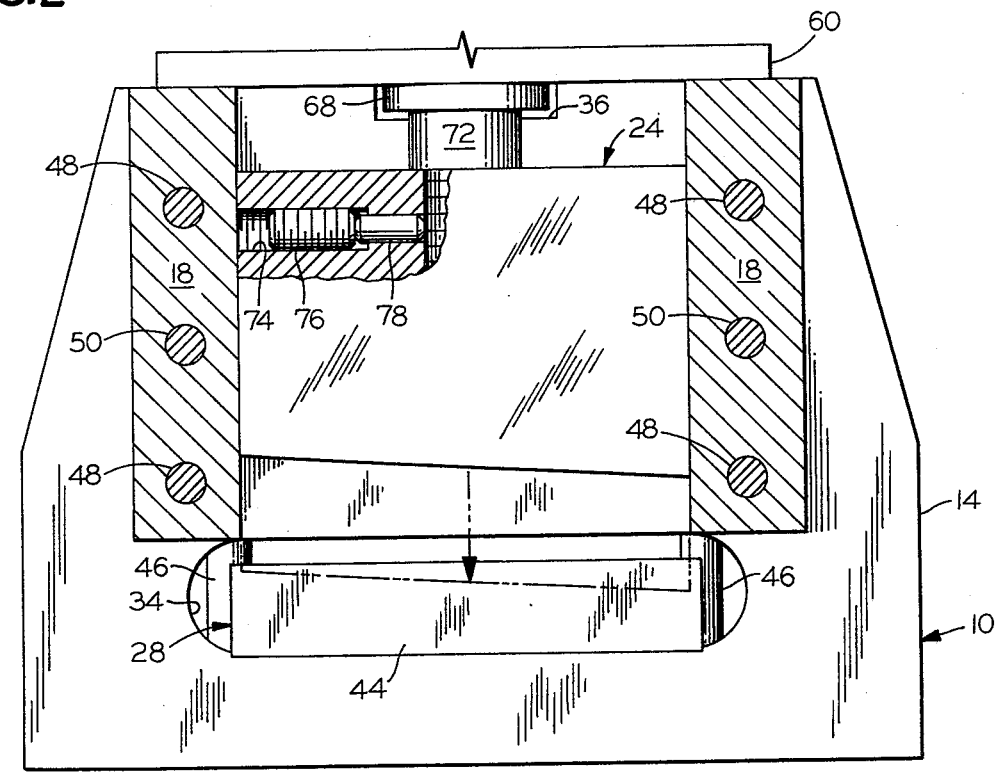
FIG. 4 is a fragmentary vertical sectional view of the apparatus of FIG. 1 intermediate the cutting member and web of the guide member drawn to an enlarged scale with a portion of the cutting member broken away to show internal structure and with phantom lines indicating a lowered position of the cutting member.

The die block 28 is secured in a recessed portion of the bed 12 by threaded fasteners and/or dowels 42 and extends into the aperture 34 with the vertical edge surface 44 thereof being recessed slightly from the adjacent vertical surface of the support member 10 to ensure proper clearance for the cutting member 24 when it is in its lowest position as shown in phantom line in FIG. 4. A pair of spaced, vertically extending dowels 46 are secured in holes through the bed 12 and function as guides for scrap strip 30 being fed therebetween over the die block 28 and through the aperture 34.

The guide member 16 is secured to the leg 14 of the support member 10 by threaded fasteners 48 and dowels 50 extending through the legs 18 thereof into engagement with the leg 14 and has a rectangular recessed portion 52 in the upper surface of the web 20 thereof horizontally aligned with the recessed portion 36 of the leg 14. A lubrication fitting 54 on the outer surface of the web 20 communicates with a recess 56 therein adjacent the cutting member 24 to facilitate lubrication thereof.

The air cylinder 26 is secured in position by means of a mounting member generally designated by the numeral 58 which consists of a rectangular base portion 60 and an upstanding support portion 62, the base portion being secured to the upper surfaces of the guide member 16 and leg 14 of the support member 10 by fasteners 64. The base portion 60 and support portion 62 have aligned vertically extending circular apertures (not shown) through the centers thereof, the aperture through the support portion 62 having a larger diameter and providing a seat for the lower portion of the air cylinder 26 secured therewithin.

The air cylinder 26 has an elongated vertically extending recess 66 therein and an annular guide 68 on the lower end thereof projecting through the aperture in and extending below the base portion 60 of the mounting member 58 with the recessed portions 36,52 of the leg 14 of the support member 10 and web 20 of the guide member 16, respectively, providing clearance for the guide 68.

A piston 70 is slidably seated in the recess 66 of the air cylinder 26 and is operatively connected to the cutting member 24 driven thereby by a rod 72 extending through apertures in the air cylinder 26, mounting member 58, and guide 68 into threaded engagement with the cutting member 24. As best shown in FIG. 4, the cutting member 24 has a double diameter horizontal bore 74 extending inwardly of a vertical edge surface thereof in which is threadably seated a retainer 76 maintaining a plug 78 in contact with the threaded portion of the rod 72. The plug 78 prevents the rod 72 from rotation and possible disengagement from the cutting member 24 as the piston 70 and rod 72 reciprocate.

Figure 2:
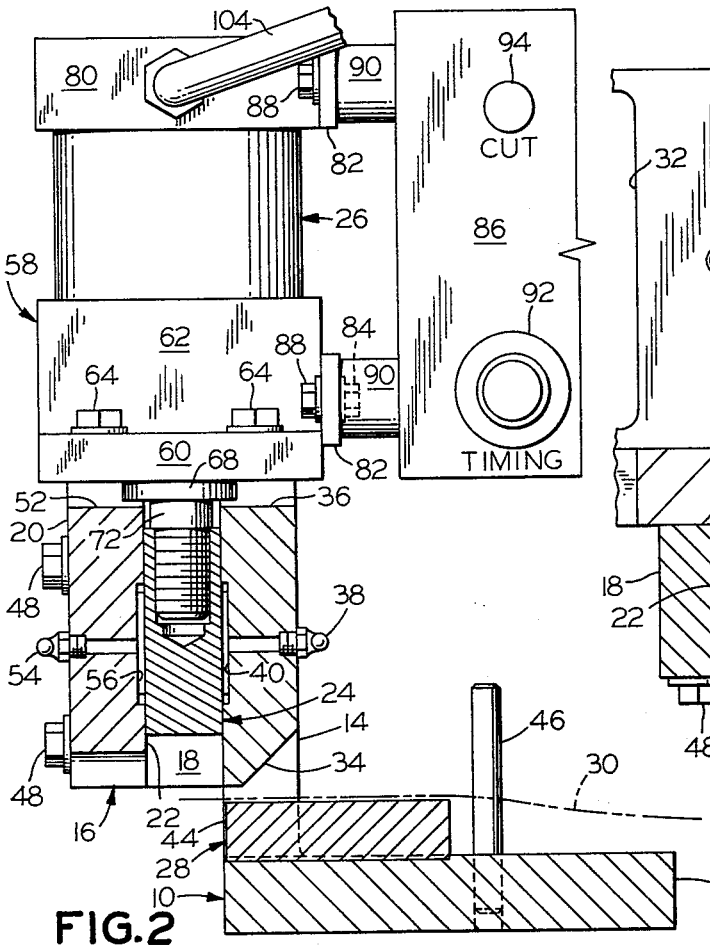
FIG. 2 is a fragmentary front elevational view of the apparatus of FIG. 1 with the lower portion thereof shown in vertical section and with a strip of scrap shown in phantom line.
Figure 3:
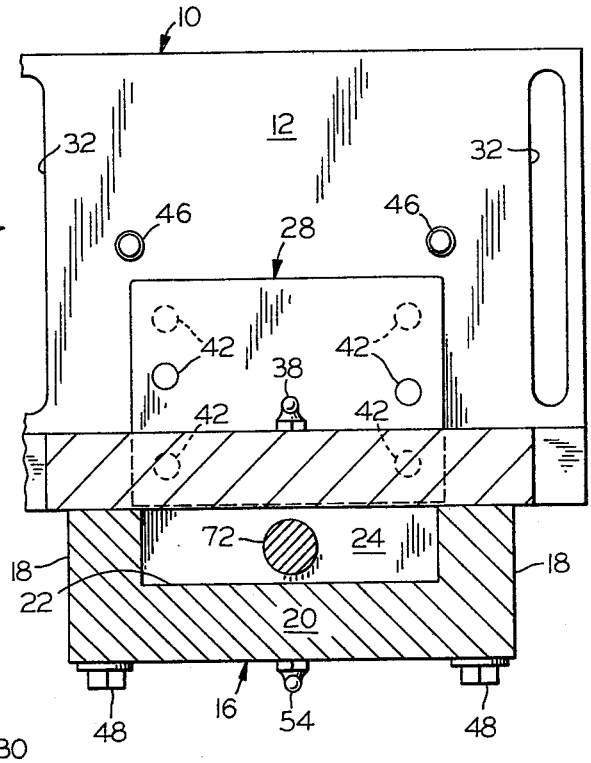
FIG. 3 is a fragmentary sectional view along the line 3—3 of FIG. 1.

Seated about and secured to the upper portion of the air cylinder 26 is a support member 80 having a rectangular external configuration. A pair of horizontal mounting brackets 82 are secured to the mounting member 58 and support member 80 by fasteners 84 (only one is shown in FIG. 2) and provide a mount for a housing 86 within which is disposed circuitry described hereinafter, fasteners 88 securing the housing 86 to the brackets 82. Disposed intermediate the brackets 82 and housing 86 are four cylindrical vibration insulators 90 secured in position by the fasteners 88 extending therethrough.

A timing control dial 92 and manual control button 94 extend outwardly of the housing 86 and are connected to the circuitry therewithin, the dial 92 functioning in a manner described hereinafter to vary the interval between successive strokes of the cutting member 24. The manual control button 94 operates as described hereinafter to actuate the cutting member 24 independently of the cycle set on the dial 92. An external power source (not shown) is connected to the circuitry within the housing 86 by a power line 96.

A two position four way solenoid controlled valve generally designated by the numeral 98, which has an inlet 100 connected to a source of pressurized air 101 (see FIGS. 7 and 8) and an air exhaust nozzle 102, is secured to the top surface of the housing 86. The valve 98 is operable as described hereinafter in connection with a description of the control circuitry shown diagrammatically in FIGS. 7 and 8 to control the air flow into and out of the recess 66 of the air cylinder 26 on opposite sides of the piston 70, thus controlling operation of the piston 70 and cutting member 24. To establish this control function the valve 98 is connected to the upper portion of the recess 66 by an advance air hose 104 and to the lower portion of the recess 66 by a retract air hose 106.

A portion of the circuitry controlling operation of the valve 98 is housed within a control box 108 secured thereto, a conduit 110 and elbow fitting 112 housing wires connecting the circuitry within the box 108 to that within the housing 86.

Figure 5:
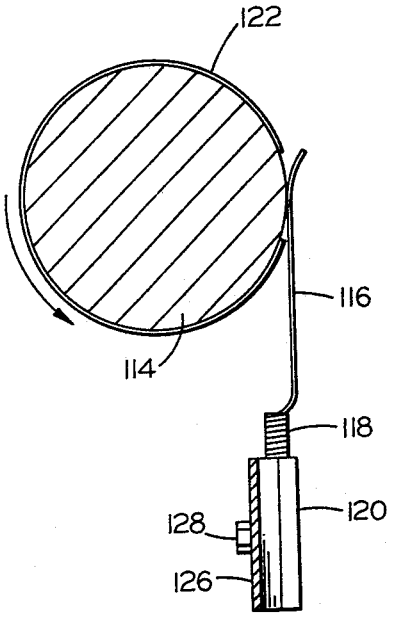
FIG. 5 is an elevational view of the electrical probes of FIG. 1 mounted for intermittent contact with the rotatable shaft of a press with the shaft shown in vertical section and to an enlarged scale.

The valve 98 is connected in circuit relation to a rotating shaft 114 of a press (not shown) or the like providing scrap strip 30 to the present invention whereby the piston 70 is intermittently actuated in response to rotation of the shaft 114. To establish this connection, as shown in FIGS. 1 and 5 a pair of probes 116 mounted in springs 118 secured to a mounting member 120 are spring biased against the shaft 114. The probes 116 are connected to the circuitry within the housing 86 by wires mounted within a conduit 111 extending between the mounting member 120 and housing 86. A strip 123 of adhesive insulating material extends about all but a portion of the shaft 114 whereby one of the probes 116 contacts the shaft 114 only once per rotation thereof. When this contact is made the probes 116, functioning as a switch, are connected in circuit relation through the shaft 114.

The mounting member 120 is secured to a support surface 124, conveniently a portion of the press providing scrap strip 30, by an L-shaped bracket 126 secured to the mounting member 120 by fasteners 128 and to the support surface 124 by fasteners 130.

Figure 6:
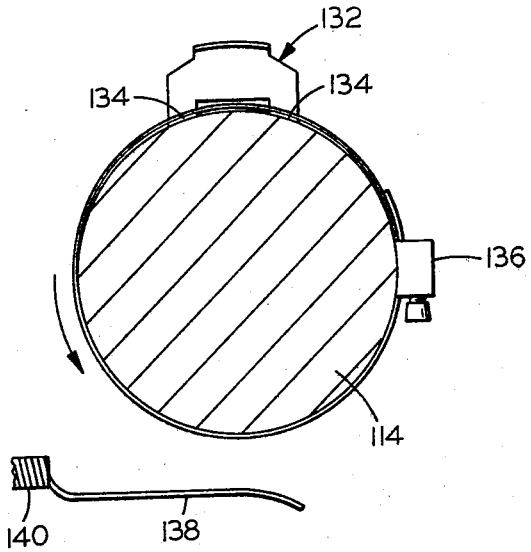
FIG. 6 is a view similar to that of FIG. 5 showing an electrical probe mounted for intermittent contact with a camming member secured to a rotatable shaft and drawn to a still further enlarged scale.

Shown in FIG. 6 is an alternative embodiment of the means for obtaining intermittent electrical contact in response to rotation of the shaft 114. A camming member generally designated by the numeral 132 having a pair of feet 134 extending perpendicularly thereto and abutting the shaft 114 is secured to the shaft 114 by a conventional adjustable clamp 136 extending thereabout over the feet 134. Supported adjacent the shaft 114 for intermittent contact with the camming member 132 is a single probe 138 mounted in a spring 140 and secured in position in a manner similar to that shown in FIG. 5. The probe 138 energizes the control circuit described hereinafter by functioning as the ground therefor, the circuit being grounded through the shaft 114 and chassis of the press to which it is operatively connected.

The insulating strip 122 or the camming member 132 is disposed at a point about the circumference of the shaft 114 so that energization of the control circuit and actuation of the cutting member 24 occur at the desired instant during the cycle of the press providing scrap strip 30, and for this reason are conveniently adjustable about the circumference of the shaft 114.

Figure 7:
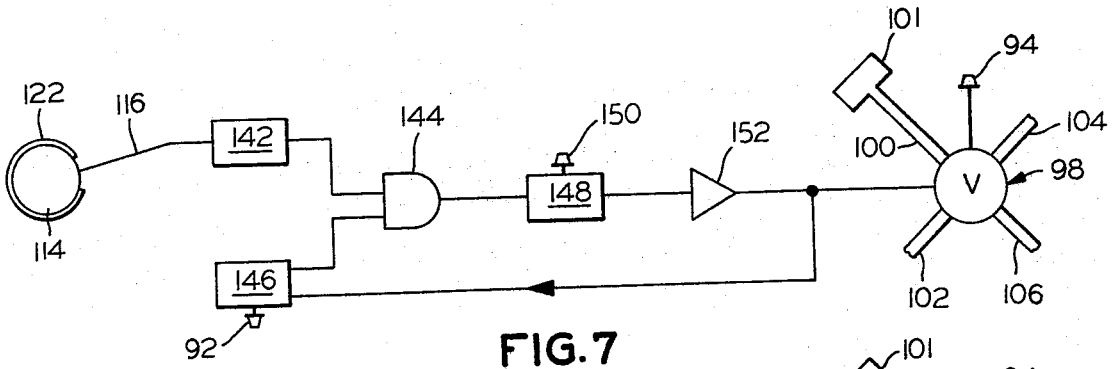
FIG. 7 is a diagrammatic illustration of a control circuit for the apparatus of FIG. 1.
Figure 8:
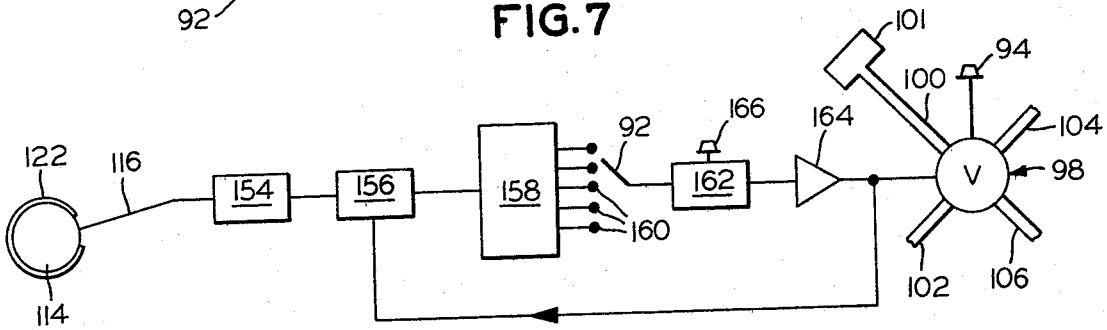
FIG. 8 is a diagrammatic illustration of another control circuit for the apparatus of FIG. 1.

Turning now to a description of the circuitry controlling the operation of the present invention, that shown diagrammatically in FIG. 7 is operable to establish a predetermined time interval between successive cuts and that shown in FIG. 8 functions to actuate intermittently the cutting member 24 following a preset number of rotations of the shaft 114. Although the means shown for energizing the circuit is that illustrated in FIGS. 1 and 5, it is to be understood that the embodiment of FIG. 6 may be used with the same effect.

In the circuit shown in FIG. 7, each time both probes 116 contact the shaft 114 a monostable multivibrator unit 142 is energized and provides a pulse to one input of an AND gate 144. A time delay unit 146 is connected to the other input of the gate 144 and applies an input thereto following a preset time interval after the cutting member 24 has been actuated, this time delay being set by the dial 92. If the time delay has not expired, the gate 144 does not pass any pulse applied by the unit 142; once the delay expires the delay unit 146 satisfies the second input of the gate 144 and the next pulse applied thereto by the unit 142 is transmitted to a second multivibrator unit 148. The pulse from the unit 148, the duration of which is controlled by a dial 150, passes to an amplifier or solenoid driver 152. The signal from the amplifier 152 controls the solenoid operated valve 98 and resets the delay unit 146 to zero so that after the preset time period expires the next pulse from the unit 142 is passed by the gate 144.

A signal from the amplifier 152 causes the valve 98 to move to a position where the source of pressurized air 101 is connected to the advance air hose 104 and the exhaust nozzle 102 is connected to the retract air hose 106, the piston 70 thus being driven downwardly to effect the cut and to expel any air on the underside thereof through the hose 106 and exhaust nozzle 102. Following a time interval corresponding to the duration of the pulse provided by the multivibrator 148 and amplifier 152, the valve 98 is de-energized and returns to a position where the air source 101 is connected to the retract air hose 106 and the exhaust nozzle 102 is connected to the advance air hose 104, the piston 70 being driven upwardly whereby the cutting member 24 is disengaged from scrap strip 30 and air above the piston 70 is expelled through the hose 104 and exhaust nozzle 102.

With reference to the control circuit shown diagrammatically in FIG. 8, each time both probes 116 contact the shaft 114 a monostable vibrator 154 is energized and applies a pulse to a binary coded decimal counter 156 which is advanced one count per pulse. As the counter 156 receives each pulse a decoder 158 energizes the appropriate one of its contact points 160 corresponding to the number of pulses applied thereto, the control dial 92 having previously been set to the desired number of rotations of the shaft 114 intermediate successive actuations of the cutting member 24. Upon energization of the contact point 160 connected to the control dial 92 a signal is passed to a multivibrator 162 which in turn applies a pulse to an amplifier 164 the duration of which is preset by a control 166. The pulse from amplifier 164 controls the valve 98 as described hereinbefore and also functions to reset the counter 156 to zero.

As shown in FIGS. 7 and 8, the manual control button 94 is connected in circuit relation to the valve 98 and functions to control operation thereof independently of rotation of the shaft 114 and control circuits. The power supply for the elements of FIGS. 7 and 8 is not shown therein, it being understood that line voltage provided to the present invention is stepped down to appropriate levels to provide the necessary power generally, it is seen that the control means may include timer means operable for presetting the time interval between successive movements of the valve means, and/or counter means operable for presetting the number of press cycles between successive movements of the value means. All such means for presetting may generally be referred to as presetting means.

The configuration and interconnection of the various elements of the present invention are preferably as described hereinbefore, although structural changes may be made so long as the invention functions essentially as described. For example, the support members need not be L-shaped but may have any configuration providing a moment for a die member and an air cylinder. If so desired, the guide member may be formed integrally with the support member to provide a passage seating the cutting member.

The electrical probes may comprise other than the double or single probe wires, such as a microswitch actuated by a cam mounted on a rotating shaft or other element of a press undergoing periodic motion. Furthermore, the control circuits of FIGS. 7 and 8 or comparable substitutes may be integrated with dual controls to provide a single circuit capable of controlling either the time interval or number of press cycles intermediate successive cuts.

Thus, it can be seen that the preset invention provides a novel apparatus for cutting scrap strip which is highly durable and capable of cutting scrap strip to any desired length by controlling either the time interval or number of press cycles between successive cuts. Furthermore, the apparatus is highly portable and may be positioned in line or at an angle to the scrap strip to cut a minimum web, thus reducing wear of the cutting member.

Having thus described the invention, I claim:

1. A portable apparatus for cutting into lengths scrap strip received from a press or the like and adapted to be positioned in line or at an angle to the scrap strip comprising:

A. a support providing a bed:

B. piston means mounted on said support for reciprocal movement of a piston toward and away from said bed, said piston having an exposed portion at its end adjacent said bed:

C. a cutting member on said exposed portion of said piston;

D. a die member on said bed cooperating with said cutting member to cut scrap strip being fed along said bed intermediate said cutting and die members:

E. a pressurized fluid inlet adapted to be connected to a source of pressurized fluid;

F. valve means connected to said pressurized fluid inlet and to said piston means to effect said reciprocal movement of said piston by controlling flow of pressurized fluid from said source, said valve means having a first operating position wherein said piston is moved toward said bed and a second operating position wherein said piston is moved away from said bed; and G. electrical control means connected in circuit relation with said valve means and including probe means adapted to be mounted adjacent to a rotating shaft of a press or the like providing scrap strip for intermittent electrical contact with said shaft occasioned by rotation thereof, said control means including presetting means operable for presetting the interval between successive movements, as defined hereinbelow, of said valve means, said control means being responsive to periodic movement of the press for a preset interval to cause said valve means to move to said first operating position thereof whereby said piston is actuated by said pressurized fluid and said cutting member is driven toward said die member to cut scrap strip therebetween, said control means moving said valve means to said second operating position thereof following said actuation of said piston whereby said cutting member is moved away from said die member.

2. The apparatus for cutting scrap strip of claim 1 further including manual control means connected in circuit relation with said valve means operable to move said valve means to said first position thereof and return said valve means to said second position thereof following actuation of said piston.

3. The apparatus for cutting scrap strip of claim 1 wherein said piston means comprises an air cylinder and said exposed portion of said piston comprises a portion of a piston rod connected to said piston.

4. The apparatus for cutting scrap strip of claim 1 wherein said valve means comprises a two position four way solenoid controlled valve.

5. The apparatus for cutting scrap strip of claim 1 wherein said control means includes as said presetting means timer means operable for presetting the time interval between successive movements of said valve means to said first position thereof.

6. The apparatus for cutting scrap strip of claim 5 wherein said probe means are adapted to make said intermittent electrical contact once per rotation of said shaft, and said control means further includes gate means having first and second inputs, and pulse means connected to said probe means and said first input of said gate means operable to apply a pulse to said first input once per rotation of the shaft in response to said probe means being in electrical contact with the shaft, said timer means being connected to said second input of said gate means and operable to satisfy said second input when said time interval has expired whereby the next pulse applied by said pulse means to said first input is passed by said gate means and is operable to move said valve means to said first position thereof and reset said timer means.

7. The apparatus for cutting scrap strip of claim 1 wherein said control means includes as said presetting means counter means adapted for monitoring the cyclical movement of the press or the like and operable for presetting the number of press cycles between successive movements of said valve means to said first position thereof.

8. The apparatus for cutting scrap strip of claim 8 wherein said probe means are adapted to make said intermittent electrical contact once per rotation of said shaft and said control means further includes pulse means connected to said probe means and said counter means operable to apply a pulse to said counter means once per rotation of the shaft in response to said probe means being in electrical contact with the shaft, said counter means being operable to move said valve means to said first position thereof following a preset number of rotations of the shaft.

* * * * *

UNITED STATES PATENT AND TRADEMARK OFFICE

CERTIFICATE OF CORRECTION

PATENT NO. : 4,085,637

DATED : April 25, 1978

INVENTOR(S) : Walter L. Michaels

It is certified that error appears in the above-identified patent and that said Letters Patent are hereby corrected as shown below:

Column 8, line 34, "Claim 8" should be --Claim 7--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*